US005251409A

United States Patent [19]

Orbank

[11] Patent Number: 5,251,409

[45] Date of Patent: Oct. 12, 1993

[54] METHOD OF DRAG FINISHING A HOUSING

[75] Inventor: Robert P. Orbank, Gurnee, Ill.

[73] Assignee: Outboard Marine Corporation, Waukegan, Ill.

[21] Appl. No.: 898,497

[22] Filed: Jun. 15, 1992

[51] Int. Cl.[5] ..... B24B 1/00; B24B 31/00

[52] U.S. Cl. ..... 51/318; 51/317; 51/313; 51/7

[58] Field of Search ..... 51/317, 318, 326, 313, 51/7, 17, 19

[56] References Cited

U.S. PATENT DOCUMENTS

| | | | |
|---|---|---|---|
| 2,106,442 | 1/1938 | Stevens | 51/326 |
| 2,494,733 | 1/1950 | Whitehead | 51/317 |
| 2,684,562 | 7/1954 | Balz | 51/317 |
| 3,464,163 | 9/1969 | Ferrara | 51/19 |
| 3,623,278 | 12/1969 | Schwartz | 51/317 |
| 4,173,851 | 11/1979 | Higashi | 51/7 |
| 4,991,360 | 2/1991 | DeSpain | 51/317 |
| 5,133,159 | 7/1992 | Nelson | 51/317 |

*Primary Examiner*—Bruce M. Kisliuk
*Assistant Examiner*—Bo Bounkong
*Attorney, Agent, or Firm*—Michael, Best & Friedrich

[57] ABSTRACT

The invention discloses a method of drag finishing a housing for use in conjunction with a drag finishing machine having a center spindle adapted to revolve around the vertical axis, a tub containing drag finishing media with the outer extent of the tub positioned radially outward of and below the spindle, a work station depending from the spindle with the work station being movable between a raised load position and a lowered dragging position and adapted to releasably receive a housing to be drag finished, the housing having a longitudinal center plane. The method discloses the steps of attaching the housing to the work station while the work station is in the load position such that the center line of the housing extends radially from the work station, canting the center plane of the housing at a first angle with respect to the horizontal, lowering the work station to the lowered dragging position and thereby lowering the housing into the media, revolving the housing in a first direction about the vertical axis of the spindle whereby the housing is dragged through the media in a first direction, and reversing the direction of revolution of the housing about the vertical axis of the spindle whereby the housing is dragged through the media in a second direction.

25 Claims, 3 Drawing Sheets

METHOD OF DRAG FINISHING A HOUSING

FIELD OF THE INVENTION

This patent relates to a method for drag finishing a housing, especially an aluminum housing adapted to support a drive shaft.

BACKGROUND OF THE INVENTION

Aluminum housings that are adapted to support drive shafts are commonly used in the outboard industry. These housings are generally made by the die casting method, which, depending on the condition of the mold, can sometimes impart a rough exterior surface on the part of sharp corners. In operation as part of an outboard motor, these housings must have a smooth exterior surface in order to be hydrodynamicly efficient as well as aesthetically pleasing. In addition, the housing must not contain any sharp corners. Preferably, the housing should have small radii and blends at all corners in order to enhance the thickness of and ability for paint to adhere entirely to the housing.

It has been found that one way to enhance the smoothness of the surface and make small blended radii on all sharp corners is to drag finish the housing. Drag finishing is a common method of finishing certain aluminum and stainless steel parts. As its name implies, the part to be finished is dragged through a media of abrasive particles. The abrasion of the particles as they pass over the part act to smooth inconsistencies in the exterior surface of the housing and impart radii on edges.

For example, propellers have been made by a drag finishing process by simultaneously dragging and spinning the propellers within the medium. It is typical in drag finishing propellers to drag a set of propellers by revolving the set around a central spindle with each propeller attached to the bottom end of a vertical shaft which also rotates as the main spindle revolves. This type of operation is not conducive for use with certain housings, as it does not allow for even abrasion over the entire housing, especially the top, since the top is near the surface of the media while being dragged.

SUMMARY OF THE INVENTION

The invention comprises a method for drag finishing a housing for use in conjunction with a drag finishing machine having a center spindle adapted to revolve about a vertical axis, a work station attached to the spindle with the work station movable between a load position and a dragging position and adapted to releasably receive a housing for a shaft and drag finishing media in a tub. The method comprises the steps of connecting a first end portion of the shaft to the housing to be drag finished, connecting a second end portion of the shaft to the work station while the work station is in the load position so that the shaft extends radially outwardly from the work station, canting the housing at a first angle by rotating the shaft about its longitudinal axis to a first angle and maintaining it at the first angle, lowering the work station to the dragging position and thereby lowering the canted housing into the media, dragging the housing through the media in a first direction for a first period of time by revolving the spindle about its vertical axis in a first direction and dragging the housing through the media in a second direction for a second period of time by revolving the spindle about its vertical axis in a second direction.

In one embodiment, the invention also comprises the steps of rotating the shaft about its longitudinal axis to a second angle and maintaining it at the second angle to cant the housing at a second angle and dragging the housing through the media in the first direction by revolving the spindle about its vertical axis in the first direction while the housing is at the second angle.

In another embodiment, while the housing is canted in the second angle, the invention also comprises the step of dragging the housing in the second direction by revolving the spindle about its vertical axis in the second direction.

The invention also comprises a method of drag finishing a housing for use in conjunction with a drag finishing machine having a center spindle adapted to revolve about a vertical axis, a tub containing drag finishing media with the outer extent of the tub positioned radially outward of and below the spindle, a work station depending from the spindle with the work station being movable between a raised load position and a lowered dragging position and adapted to releasably receive a housing to be drag finished, the housing having a longitudinal center plane. The method comprises the steps of attaching the housing to the work station while the work station is in the load position such that the center line of the housing extends radially from the work station, canting the center plane of the housing at a first angle with respect to the horizontal, lowering the work station to the lowered dragging position and thereby lowering the housing into the media, revolving the housing in a first direction about the vertical axis of the spindle whereby the housing is dragged through the media in a first direction, and reversing the direction of revolution of the housing about the vertical axis of the spindle whereby the housing is dragged through the media in a second direction.

In a preferred embodiment, the method also comprises the steps of canting the center plane of the gear case at a second angle which is different than the first angle and revolving the housing in the first direction about the vertical axis of the spindle whereby the housing is dragged the media in the first direction.

In one embodiment the first angle is between 5° and 30° and the second angle is approximately 150° from the first angle.

In one embodiment, the housing has a first bore extending radially outwardly from the work station and the means for attaching the housing to the work station extends through the bore.

In another embodiment, the housing also has a second bore extending at an angle to the first bore and the method further comprises a means for plugging the second bore.

In another embodiment, the plugging means also manipulates the attaching means.

The invention also comprises a method of drag finishing a housing for use in conjunction with a drag finishing machine having a center spindle adapted to revolve about a vertical axis, a tub containing drag finishing media with the outer extent of the tub positioned radially outward of and below the spindle, a work station depending from the spindle with the work station being moveable between a raised load position and lowered dragging position and adapted to releasably receive a housing to be drag finished, with the housing having a longitudinal center plane. The method comprises the steps of attaching the housing to the work station while the work station is in the load position such that the center plane of the housing extends radially from the work station, canting the center plane of the housing at a first angle with respect to the horizontal, lowering the work station to the lowered dragging position and thereby lowering the housing into the media, revolving the housing about the vertical axis of the spindle whereby the housing is dragged through the media, canting the center plane of the housing at a second angle with respect to the horizontal, and rotating the housing about the vertical axis of the spindle whereby the housing is dragged through the media.

Figure 1:
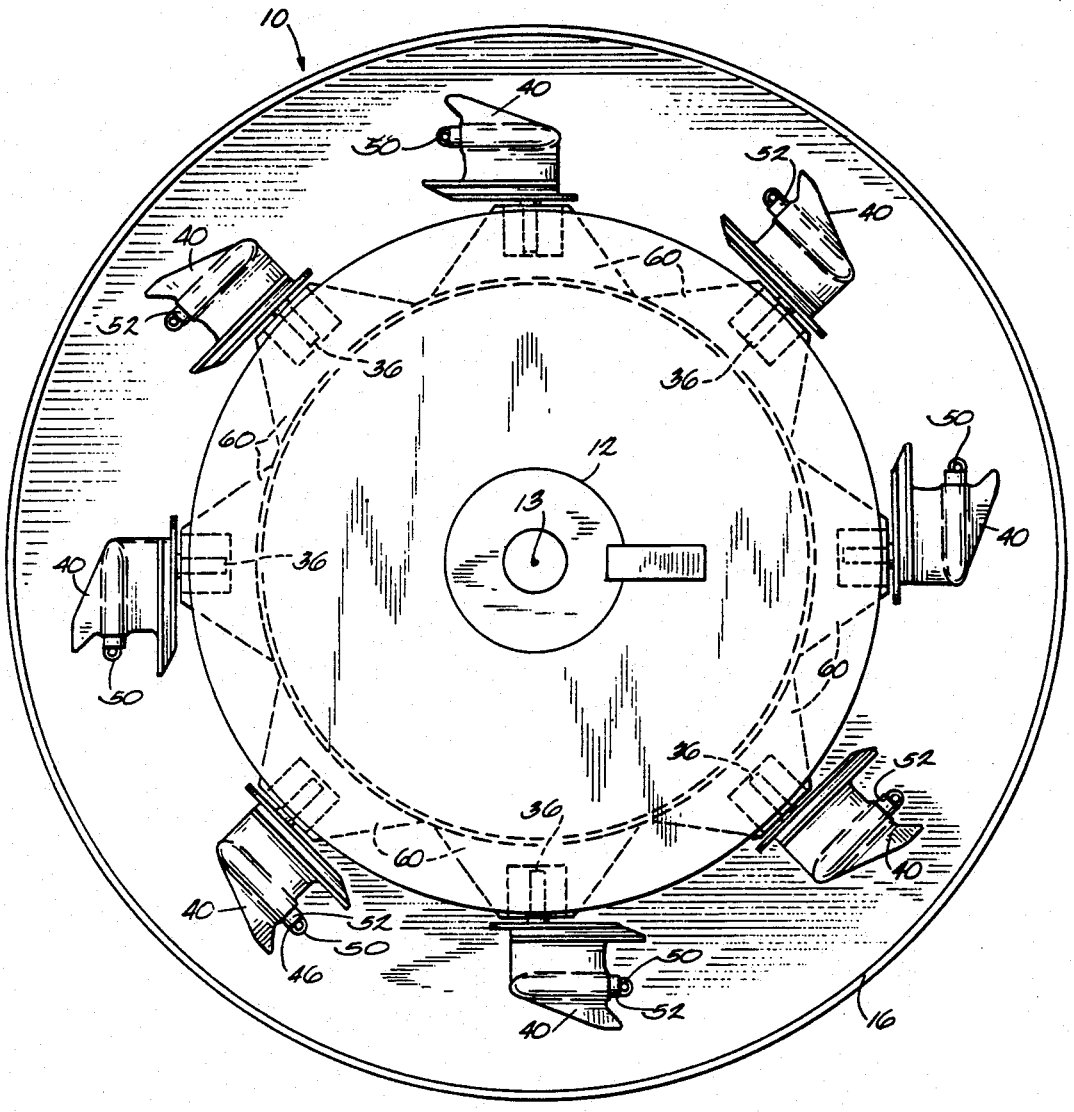
FIG. 1 is a top plan view of a drag finishing machine with outboard gearcases mounted thereon.

Before describing at least one embodiment of the invention in detail, it is to be understood that the invention is not limited in its application to the details of construction and arrangements of the components set forth in the following description and illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE PREFERRED EMBODIMENT

The invention comprises a new and novel method for drag finishing a housing adapted to support a shaft such as an outboard motor gearcase, outer exhaust housing, swivel bracket or stern bracket through a special adaptation of a drag finishing machine.

Drag finishing machines are known in the art. For example, drag finishing machines are manufactured by Walther Corporation having an address of Highway 110E., P.O. Box 409, Heber Springs, Ariz. 72543. Typically these machine have a center spindle with a plurality of work stations depending therefrom around the spindle's outer radius. Each work station has a vertically depending shaft that holds a part to be drag finished in a stationery media. By this construction, each part can be revolved around the center spindle and rotated about its shaft while being dragged through the media. These machines work effectively on some parts, but are not effective for parts such as outboard motor gearcases and outer exhaust housings primarily because the vertical orientation of the part causes the top thereof to not be fully finished. It is also known to drag finish a part by holding it stationary and run a coarse media over it.

As shown in FIG. I, the machine used in conjunction with the present invention also comprises a center spindle I2 which is supported by an exterior frame (not shown) for revolution around a center axis 13. Depending from the outer radius of the spindle is a plurality of work stations 14. The drag finishing machine depicted in the drawings is a Walther Maxi Drag adaptable to include either 8 or 12 work stations 14 depending on the size of the housing to be drag finished.

Below the spindle 12 and inboard of the frame is a stationary annular tub 16 which is filled with a drag finishing media 18. In a preferred embodiment, the media is a plastic or ceramic stonelike aggregate of one or more of the following media types: Walther WPHC, Walther WPBC, Almco EC5-8WG or Almco EC3-4WG.

Figure 3:
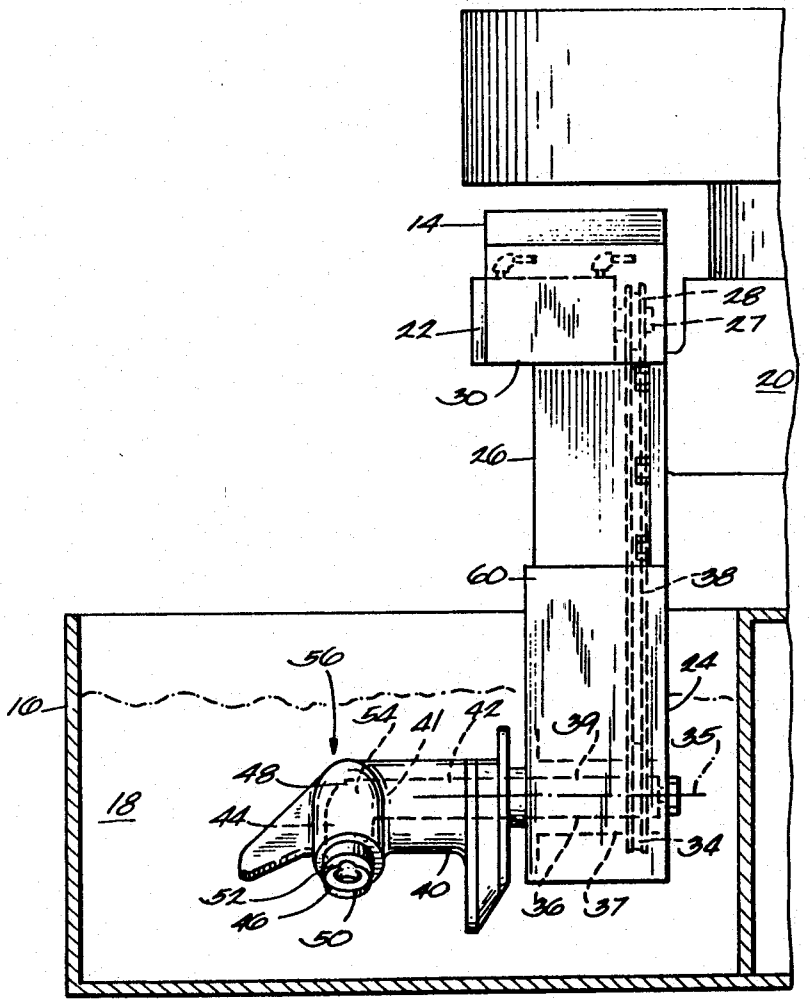
FIG. 3 is a cut away view of a work station having an outboard gearcase attached thereto with the gearcase canted at an angle with respect to the horizontal.
Figure 2:
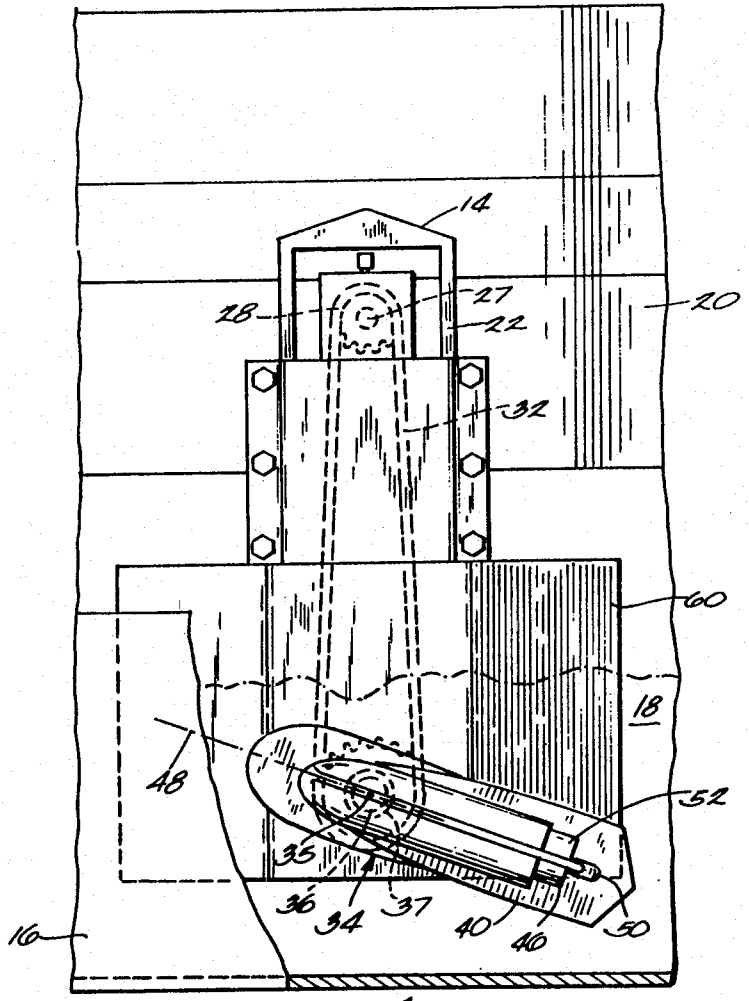
FIG. 2 is a side elevation view of a work station with an outboard gearcase mounted thereon with the center plane of the gearcase canted at an angle with respect to the horizontal.
Figure 7:
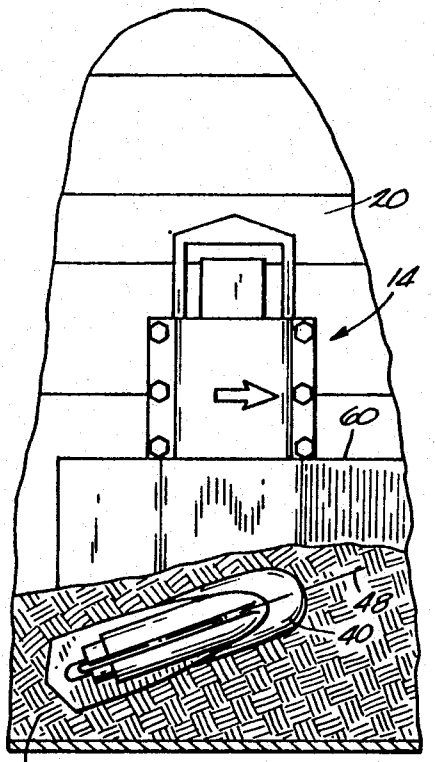
FIGS. 4 through 7 are side elevation views of a work station in the dragging position with an outboard gearcase being drug through the media in a canted position with arrows indicating the direction of movement of the gearcase through the media.
Figure 6:
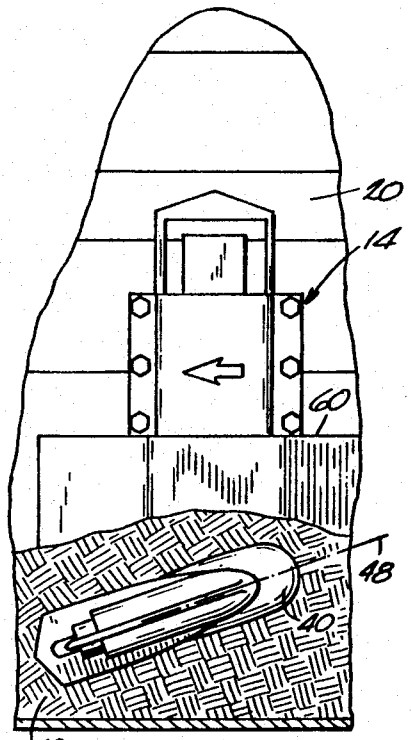
Figure 5:
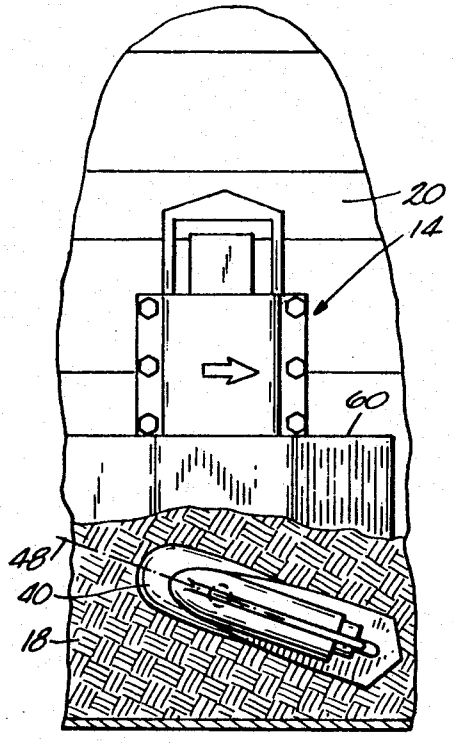
Figure 4:
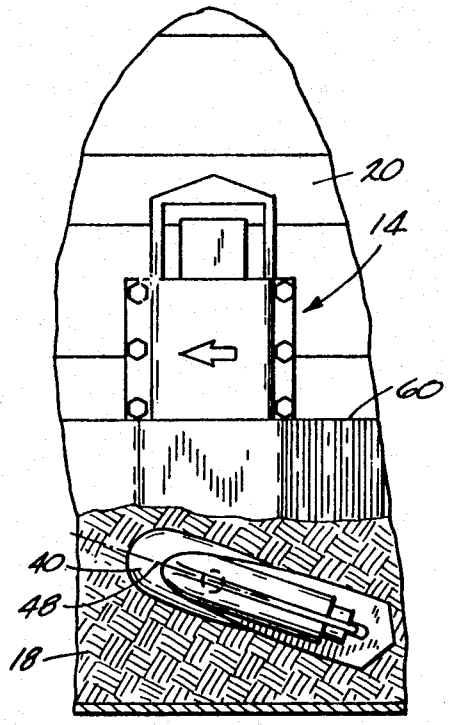

As shown in FIGS. 1, 2 and 3 in the preferred embodiment, the drag finishing machine has a plurality of work stations 14. Each depending work station is attached to a circular ring 20 which forms the outer radius of the spindle 12. The ring 20 and work stations 14 revolve around the vertical center axis of the spindle and also move axially up and down to place the work stations 14 in a raised load position and a lowered drag position. The spindle is revolved by means of a hydraulic motor driven by a hydraulic pump (not shown).

As can be better seen in FIG. 3, each work station comprises an upper portion 22 and a lower portion 24. Connecting the two portions is a vertical leg 26 which is sufficiently rigid to withstand the bending forces caused by the drag of the work station and the housing to be finished through the media when the ring 20 is rotated.

As shown in FIG. 2, the upper portion 22 of the work station 14 also comprises an upper sprocket 28 which rotates about a horizontal axis 27 that extends radially outward from the center vertical axis 13 of the spindle. The rotation of the sprocket 28 is controlled by a hydraulic pneumatic rotary actuator 30. The sprocket drives a chain or continuous belt 32. The chain 32 operatively connects the upper sprocket 28 with a lower sprocket 34 so that the movement of the motor and upper sprocket will also cause rotation of the lower sprocket 13 about its horizontal axis 35, which also extends radially outward from the center vertical axis 13 of the spindle.

The sprockets are retained in the upper and lower portions respectively of the work station 14 by means of suitable bearings. Extending radially outwardly from and connected to the lower sprocket is a hollow cylindrical tube 37.

When loaded with a part to be drag finished, a shaft 36 extends radially outwardly from the lower portion of the work station and through the cylindrical tube. One end portion of 39 shaft 36 is connected to the tube and the sprocket 38 so that the shaft will rotate about its horizontal longitudinal axis as the sprocket 34 rotates. The other end of the shaft 41 is connected to the housing 40 to be drag finished.

The housing 40 to be finished is attached to the other end portion 41 of the shaft 36 so that it does not revolve on the shaft. For example, in the embodiment shown, the housing 40 is a gearcase for an outboard motor. The shaft extends through a longitudinal bore 42 that extends from the top of the gearcase to a point within the gearcase. A second bore 44 extends from the aft end of the gearcase and intersects the longitudinal bore 42 at a right angle. Plug 46, which has a metal center rod 50 and a plastic sheath 52 is inserted into the second bore with an attachment means 54 at the end of the plug 46 to secure the housing to the shaft 36 so that the housing 40 is not allowed to rotate thereon. The housing 40, plug 46 and shaft 36 can be preassembled as an assembly 56.

The housing shown in the drawings has a center plane 48 as best shown in FIG. 2. This center plane extends longitudinally through the housing and through the centers of each of the first 42 and second 44 bores.

In a preferred embodiment, each work station 14 is loaded with a horizontal shaft and housing assembly 56 by inserting the one end 39 of the shaft 36 into the hollow cylinder 37 and locking it in place. The attitude of the center plane 48 of the housing 40 is canted and held at an angle with respect to the horizontal by means of rotating the upper and lower sprockets and locking the sprockets into position. It has been found that attitudes of between approximately 5° and 30° are preferred for most housings. For the gearcase shown in the drawing, an attitude of approximately 15° from the horizontal is preferable.

The spindle 12 is then actuated and accelerated to the proper revolving velocity by the hydraulic motor while the work station 14 and housing 40 are still above the media. It has been found that the proper velocity for a housing similar to that shown in the drawings is, between 200 and 500 feet per minute which arises from a revolving speed of between 6 and 15 rpm to obtain the proper surface finish. The work stations and housings are then gradually lowered into the media so that the lower portions of the work stations and the housings are fully submerged and travel through the media 18 in a circular direction around the vertical center axis 13 of the spindle.

In other words, the housing 40 revolves around the axis of the spindle 13 while the attitude of its center plane 48 is canted with respect to the horizontal. The housing 40 is then dragged through the media 18 for a first period of time in this direction while canted at this angle. In a preferred embodiment, the spindle 12 is then halted and the housing is then dragged in the reverse direction for a second period of time. These periods of time can be equal or one can be longer than the other depending on the geometry of the housing 40 and the needs of the housing with respect to enhancing its surface finish.

In a preferred embodiment, after the housing is dragged in two directions while canted at the first angle, the work stations 14 are then raised up and the housing 40 is removed from the media. The motor 30 is then operated to drive the chains and the lower sprocket 34 is then locked to cant the housing 40 at a second angle. In a preferred embodiment, this angle is also approximately 15° from the horizontal or 150° from the first angle. The spindle 12 is then accelerated to dragging velocity and the work station and housing are again lowered into the media and dragged in either one or preferably in both directions at the second canted angle so that other surfaces of the housing are initially confronted with the media and the housing can be optimally drag finished.

It could be beneficial to change the angle of the housing while the housing 40 is in the lowered dragging position and the invention should be construed to encompass this type of an operation.

The dragging of the housing through the media 18 causes the media to rub on the housing giving it a smooth surface. In addition, all sharp edges, such as those on the lower portion of the skeg and also at the very top portion of the gearcase, where it meets the lower unit, are blended into the straight surfaces and given a slightly rounded or radiused corner. This aids in allowing the paint to adhere to the corners which reduces the opportunity for the paint to peel away from the housing 40 at the corner which in turn reduces the chances of corrosion while the gearcase is in use as part of an outboard motor.

Since the lower portion of the work station is also submerged into the media and the gearcase is positioned with its longitudinal axis essentially horizontal, the top and bottom are exposed to the full force of the media. This is beneficial, since these are two of the areas that especially need this treatment. It can be appreciated that if the gearcase were hung from a vertically oriented shaft into the media, the top of the gearcase would not be fully exposed to the media and would not be optimally finished.

It can also be appreciated that the lower portion of the work station is also dragged through the media by this process. A special plastic protective cover 60 is placed over the lower portion of the work station in order to reduce the amount of wear experienced by the work station itself. Moreover, while housings are being dragged, soap solution diluted by water is sprayed onto the media to reduce the generation of dust and wash away broken down media. The broken media is drained at the bottom of the tub and filtered off and disposed of.

Various features and advantages of the invention are set forth in the following claims.

I claim:

1. In conjunction with a drag finishing machine having a center spindle adapted to revolve about a vertical axis, a work station attached to said spindle for rotation therewith, adapted to releasably support a housing for a shaft, and movable between a load position and a dragging position with said housing immersed in media in a stationary tub, said housing including a center plane containing said shaft, a method of drag finishing said housing comprising the steps of:

connecting a first end portion of said shaft to said housing to be drag finished;

connecting a second end portion of said shaft to said work station while said work station is in said load position so that said shaft extends radially outwardly from said work station;

canting said center plane of said housing at a first angle to a plane perpendicular to said vertical axis by rotating said shaft about its longitudinal axis to said first angle and maintaining said shaft at said first angle;

displacing said work station to said dragging position and thereby immersing said canted housing into said media;

dragging said housing through said media in a first direction for a first period of time by revolving said spindle about said vertical axis in a first direction; and dragging said housing through said media in a second direction for a second period of time by revolving said spindle about said vertical axis in a second direction.

2. The method of claim 1 also comprising the steps of:

rotating said shaft about said longitudinal axis to a second angle and maintaining said shaft at said second angle to cant said housing at said second angle; and, dragging said housing through said media in said first direction for a third period of time by revolving said spindle about said vertical axis in said first direction while said housing is at said second angle.

3. The method of claim 2 also comprising the step of dragging said housing in said second direction for a fourth period of time by revolving said spindle about said vertical axis in said second direction.

4. The method of claim 3 wherein said fourth period of time is between 1 to 3 minutes.

5. The method of claim 4 wherein the total of said third and fourth period of time is between 2 and 6 minutes.

6. The method of claim 2 wherein said third period of time is between 1 and 3 minutes.

7. The method of claim 1 wherein said first period of time is between 1 and 3 minutes.

8. The method of claim 1 wherein said second period of time is between 1 and 3 minutes.

9. The method of claim 1 wherein the total of the first and second periods of time is between 2 and 6 minutes.

10. The method of claim 1 wherein said shaft is rotated in one rotative direction and the first angle is between 5° and 30° to the horizontal.

11. The method of claim 10 wherein shaft is rotated for said second period of time in the other rotative direction and said second angle is between 5° and 30° to the horizontal.

12. In conjunction with a drag finishing machine having a center spindle adapted to revolve about a vertical axis, a tub containing drag finishing media and having an outer extent positioned radially outward of and below said spindle, a work station depending from the spindle with said work station being movable between a raised load position and a lowered dragging position and adapted to releasably receive a housing to be drag finished, said housing having a longitudinal center plane, a method of drag finishing said housing comprising the steps of:

attaching said housing to said work station while said work station is in said load position such that said longitudinal center plane of said housing extends radially from said work station;

canting said longitudinal center plane of said housing at a first angle with respect to the horizontal;

lowering said work station to said lowered dragging position and thereby lowering said housing into said media;

revolving said housing in a first direction about the vertical axis of the spindle whereby said housing is dragged through the media in a first direction; and, reversing the direction of revolution of said housing about the vertical axis of the spindle whereby said housing is dragged through the media in a second direction.

13. The method of claim 12 also comprising the steps of canting said housing at a second angle which is different than the first angle and rotating said housing in said first direction about said vertical axis of said spindle whereby the housing is dragged through the media in said first direction.

14. The method of claim 13 wherein said second angle is approximately 150° from the first angle.

15. The method of claim 12 wherein said first angle is between 5° and 30°.

16. The method of claim 12 wherein said housing has therein a first bore extending radially outwardly from said work station and including therein means for attaching said housing to said work station.

17. The method of claim 16 wherein said housing also has a second bore extending at an angle to said first bore and the method further comprises a means for plugging said second bore.

18. The method of claim 17 wherein said plugging means also manipulates said attaching means.

19. The method of claim 18 wherein said plugging means has a metal central shaft and a plastic cylindrical housing around the central shaft.

20. The method of claim 12 wherein said housing is rotated through said media at a linear speed between 100 and 500 feet per minute.

21. The method of claim 12 wherein the housing is dragged through the media for a predetermined time in each direction.

22. The method of claim 12 wherein said revolving in said first direction occurs for approximately 2 minutes.

23. In conjunction with a drag finishing machine having a center spindle adapted to revolve about a vertical axis, a tub containing drag finishing media and having an outer extent positioned radially outward of and below the spindle, a work station depending from the spindle with said work station being movable between a raised load position and a lowered dragging position and adapted to releasably receive a housing to be drag finished, said housing having a longitudinal center plane, a method of drag finishing said housing comprising the steps of:

attaching said housing to said work station while said work station is in said load position such that said longitudinal center plane of said housing extends radially from said work station;

canting said center plane of said housing at a first angle with respect to the horizontal;

lowering said work station to said lowered dragging position and thereby lowering said housing into said media;

revolving said housing about the vertical axis of the spindle whereby said housing is drug through the media;

canting said longitudinal center plane of said housing at a second angle with respect to the horizontal; and rotating said housing about the vertical axis of the spindle whereby said housing is drug through the media.

24. The method of claim 23 wherein the drag finishing machine comprises a plurality of work stations radially spaced from each other and depending from the spindle.

25. The method of claim 24 wherein said work stations of the drag finishing machine also extend radially outwardly from said spindle.

* * * * *